United States Patent [19]

Hafer

[11] Patent Number: 4,460,179

[45] Date of Patent: Jul. 17, 1984

[54] EDUCATIONAL TARGET GAME

[76] Inventor: Linda B. Hafer, 9218 Rockefeller, Springfield, Va. 22153

[21] Appl. No.: 430,252

[22] Filed: Sep. 30, 1982

[51] Int. Cl.[3] ..... A63F 9/02

[52] U.S. Cl. ..... 273/402; 273/428; 434/127

[58] Field of Search ..... 273/1 G, 1 GC, 398–402, 273/428, 424, 345–347, 58 A; 434/127, 81

[56] References Cited

U.S. PATENT DOCUMENTS

| | | | |
|---|---|---|---|
| 812536 | 2/1906 | Warren | 273/402 |
| 2,314,387 | 3/1943 | Carlsson | 434/127 |
| 3,518,786 | 7/1970 | Holtvoigt | 273/58 A X |
| 3,547,436 | 12/1970 | Breslow | 273/1 GC |
| 3,553,062 | 1/1971 | Berlin | 434/81 X |
| 3,582,070 | 6/1971 | Breslow | 273/1 G |
| 3,769,720 | 11/1973 | Terrones | 434/127 |
| 3,971,562 | 7/1976 | Peterson | 273/402 |
| 4,253,672 | 3/1981 | Milzoff et al. | 273/424 |

FOREIGN PATENT DOCUMENTS 2501053 9/1982 France ..... 434/127

OTHER PUBLICATIONS

Placo Products Co., Circular 3-1970, Bean Bag Skill Game No. 440.

Playthings, 1-1977, p. 13, Dinner Darts.

*Primary Examiner*—Paul E. Shapiro

*Attorney, Agent, or Firm*—Cushman, Darby & Cushman

[57] ABSTRACT

A fun game that can teach players important dietary information. Soft projectiles are shaped like food items of the food groups (e.g. a number of projectiles are shaped like fruits and vegetables, a number shaped like dairy products, etc.). The target utilized is one having an opening simulating a smiling mouth, and the players attempt to throw the projectiles through the opening. Scorecards indicate the number of food items from each group to be tossed through the opening to have a good "diet", and playing cards may be utilized to change the number of items from each group.

8 Claims, 4 Drawing Figures

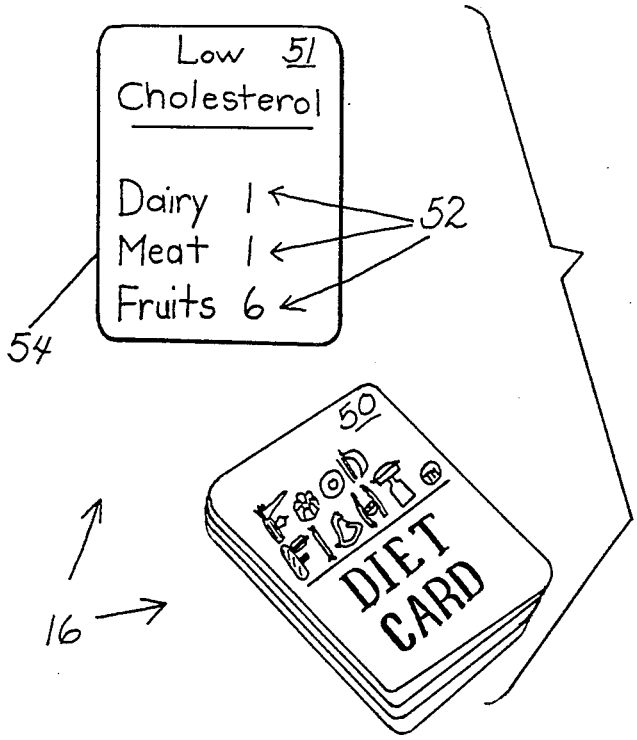
Fig. 3
Fig. 4
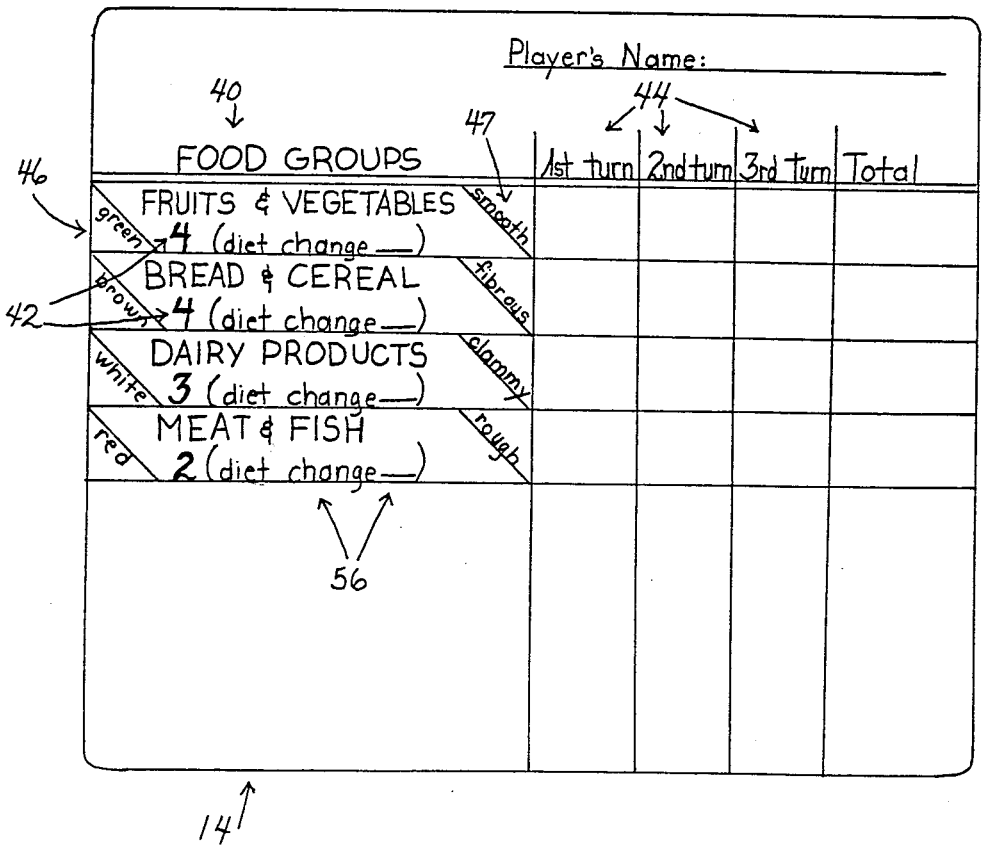

EDUCATIONAL TARGET GAME

BACKGROUND AND SUMMARY OF THE INVENTION

Ideally, games should be fun, versatile, and educational. The game according to the invention has each of these three characteristics. It has an unusual theme and game apparatus which are sure to provide amusement. The game projectiles can be used in the play of a normal game, to be thrown by the players at each other to simulate a "food fight", or as decorations or conversation pieces. The proper play of the game provides important basic dietary information which is useful to all players.

It is the primary object of the present invention to provide a fun, versatile, and educational game. This and other objects of the invention will become clear from an inspection of the detailed description of the invention and from the appended claims.

BRIEF DESCRIPTION OF THE DRAWINGS

FIG. 3 schematically illustrates a deck of playing cards that may optionally be utilized in playing the game according to the invention; and FIG. 4 is a top plan view of an exemplary scorecard which is part of the apparatus of the game according to the invention.

DETAILED DESCRIPTION OF THE DRAWINGS

Figure 1:
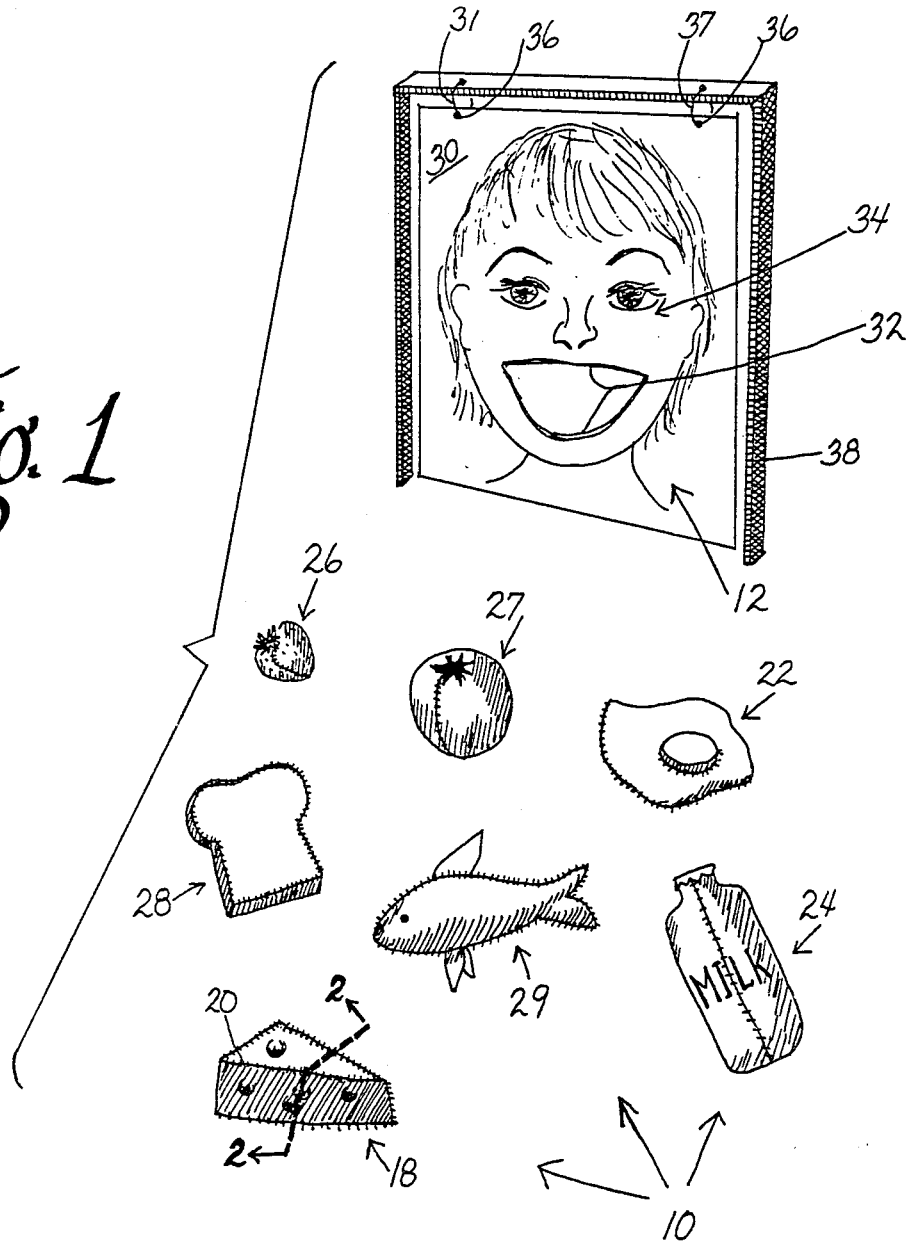
FIG. 1 is a perspective schematic of a plurality of exemplary projectiles and an exemplary target useful in playing the game according to the present invention.

The basic components of the game include a plurality of groups of soft projectiles—shown generally by reference number 10 in FIG. 1—a target—shown generally by reference numeral 12 in FIG. 1—and a scorecard 14 (see FIG. 4). Additionally the game apparatus preferably includes a deck of playing cards 16 (see FIG. 3).

Figure 2:
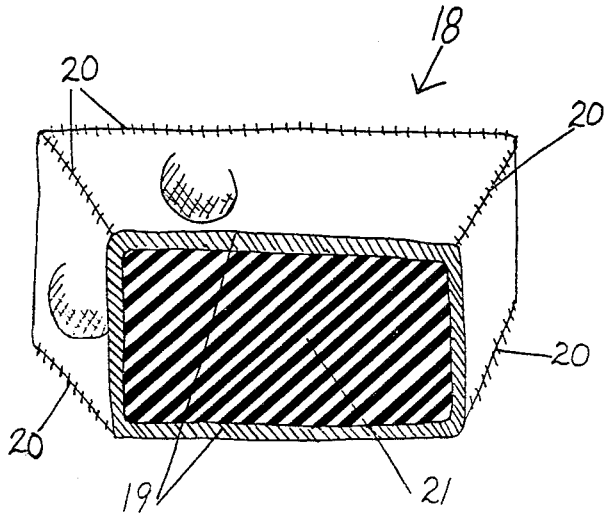
FIG. 2 is an end cross-sectional view of an exemplary projectile of FIG. 1.

Each of the projectiles is soft, preferably being formed by an outer layer of cloth and an inner layer of soft, resilient material. For instance as illustrated in FIG. 2 for a projectile 18, the outer portion of the projectile comprises a layer of cloth 19 with stitching formed along hem 20 to form a closed structure. Disposed in the interior of the outer covering 19 is a piece of foam rubber 21. Instead of foam rubber a number of other materials may be used, such as plastic foam, pieces of plastic foam and/or foam rubber, a polyester fiberfill, etc. Alternatively the entire projectile can be of soft plastic.

There are a plurality of groups of projectiles, with a plurality of projectiles simulating food items in each group. All the items in each group simulate food items in conventional food groups, i.e. fruits and vegetables; bread and cereal; dairy products; meats and fish; etc. For instance—as illustrated in FIG. 1—a plurality of projectiles 18 (cheese), 22 (fried egg), and 24 (a bottle of milk) simulate food items in the dairy product food group. There are a plurality of soft projectiles forming simulated food items for each of the other food groups, such as the projectile 26 simulating a strawberry, the projectile 27 simulating a tomato, the projectile 28 simulating a piece of bread, and the projectile 29 simulating a fish.

The target 12 includes a piece of sheet material 30 having means defining a crescent-shaped through-extending opening 32 therein. The opening 32 is significantly larger than the largest dimension of any of the projectiles 10. The target 12 also includes indicia 34 simulating a human face with the crescent-shaped opening defining the mouth (preferably smiling) of the human face. Preferably the sheet material 30 is a flexible piece of thermoplastic material, and eyelets 36, and/or pieces of string or tape 37, or the like are utilized to hang the plastic sheet 30 vertically, such as in a doorway 38. Alternatively the sheet 30 may be a rigid material and may be supported by braces. A wide variety of other alternatives are also possible.

The scorecard 14 includes a column 40 which lists the food groups which correspond to the groups of projectiles 10. Each food group listing also includes a numerical indicia 42 which represents the number of units of that food group that a human should consume periodically to have a good diet. For instance—with reference to FIG. 4—a human preferably would consume four units of fruits and vegetables each day in a normal healthy diet.

The scorecard 14 further includes a plurality of columns 44 which are blank and allow the player to enter the number of simulated projectiles of the food group associated with the scorecard box that she or he threw through the mouth opening 32 of the target 30.

Indicia may also be associated with the projectiles and the scorecard food group listings to make it easier for children, or others, to keep track of what foods are in which food groups, and thus what type of projectiles must be thrown through the mouth-opening 32 in the target 12. For instance there can be color indicia, such as coloring all the projectiles in the fruits and vegetables group green (or providing a green stripe, star, or the like thereon), and then providing similar indicia 46 associated with the food group listing 40 on the scorecard 14 corresponding to that color indicia. Similarly, the textures of the projectiles of each group could be different; or the textures of different projectiles within each group could be different. For instance the texture of the fruits and vegetables projectiles (e.g. 26, 27) could be smooth, and that tactile indicia 47 would be on the appropriate scorecard food group listing in column 40.

In order to provide for an even broader educational experience, and to introduce variety into the game, the playing cards 16 —which may be denoted "diet cards'-'—may be utilized. Each card has a "back" face 50 which does not have game-relevant information thereon, and a "front" face 51 which indicates a different type of diet for the particular player selecting the card. The diet information provided on the face 51 would have at least one food group listing and a numerical indicia 52 associated with that food group listing which was different than the numerical indicia 42 printed on the scorecard 14. For instance for the playing card 54 illustrated in FIG. 3, which denotes a "low cholesterol" diet, the number of dairy units would be changed from three to one, the number of meat units from two to one, and the number of fruits and vegetables units from four to six, on that player's scorecard 14. Preferably preprinted indicia 56 are provided on the scorecard 14 for each food group listing 40 to allow easy entry of a diet change.

EXEMPLARY MANNER OF PLAY

One exemplary manner of play is as follows:

A first player inserts her/his name on the scorecard 14, picks a diet card 16, and indicates any changes in her/his diet at the places 56 in the column 40. Assume that the card 16 selected by that player indicates no change in the diet.

The player takes all, or a portion, of the game projectiles 10 from a variety of food groups, and sequentially throws them at the target 12, attempting to get them through the mouth-shaped opening 32. After she/he has thrown all of the projectiles, she/he goes to the back of the target 12, and records the number of food items simulating projectiles from each of the food groups listed in column 40 in the "first turn" column 44. For any food group wherein she/he has thrown through the opening 32 the number of food items in a food group corresponding to the numerical indicia 42 associated with that group, the player enters that number in the "total" column on the scorecard 14.

After other players have taken their turn, the first player again selects a number of projectiles to try and complete her/his "diet" for the day. This time, instead of utilizing all, or substantially all, of the projectiles, the player is careful to select only projectiles from food items simulating groups corresponding to the food groups in column 40 for which she/he has not yet matched the numerical indicia 42. For instance if the player has already thrown four fruits and vegetables simulating projectiles (e.g. 26, 27) through the opening 32 on her/his first turn, but has thrown through only one dairy product simulating projectile (e.g. 18, 22, 24) through the opening 32, she/he would select the dairy products simulating projectiles (e.g. 18, 22, 24), but not the fruits and vegetables group simulating projectiles (e.g. 26, 27), on the next round.

The player continues with her/his turn until the numerical value 42 for each food group is achieved. The first player to achieve that desired result—without going over the number of food item units indicated—can be declared the winner.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent games and apparatus.

What is claimed is:

1. A game comprising:

a first group of projectiles comprising a plurality of differently shaped soft projectiles, each projectile in said first group shaped to simulate an item of food in a first food group;

a second group of projectiles comprising a plurality of differently shaped soft projectiles, each projectile in said second group shaped to simulate a food item in a second food group;

a target comprising a piece of sheet material with means defining a generally crescent-shaped opening therein, said opening being significantly larger than the largest dimension of any of said soft projectiles;

indicia means formed on said target face to simulate a human face with said crescent-shaped opening defining the mouth of said simulated human face; and a plurality of scorecards, each scorecard having first and second food groups listed in a row or column thereof, said first and second food groups corresponding to the simulated projectiles of said first and second groups of projectiles, respectively, and each food group indicia on said scorecard including a numerical value corresponding to the desired periodic human consumption of units of the food group with which said numerical indicia is associated.

2. A game as recited in claim 1 wherein each of said projectiles comprises an outer cloth covering and an inner filling of soft, resilient material.

3. A game as recited in claim 2 wherein said soft, resilient material is selected from the group consisting essentially of: foam rubber, plastic foam, and a plurality of small pieces of either.

4. A game as recited in claim 1 further comprising a third group of a plurality of differently shaped soft projectiles shaped to simulate food items in a third food group, and a fourth group of a plurality of differently shaped projectiles shaped to simulate food items in a fourth food group; and wherein said first food group comprises fruits and vegetables, said second food group comprises bread and cereal, said third food group comprises dairy products, and said fourth food group comprises meats and fish.

5. A game as recited in claims 1, 2, or 4 further comprising a plurality of playing cards, each card having indicia formed on one face thereof corresponding to at least one of said food groups on said scorecard, and indicating a different numerical value for said food group on said scorecard than the numerical indicia present on said scorecard for said food group.

6. A game as recited in claim 1 further comprising a particular color indicia associated with each projectile of each group, and distinct from the color indicia of the projectiles associated with each other group; and wherein said scorecard includes indicia associated with each food group listing indicating the color indicia for the projectiles of that food group.

7. A game as recited in claim 1 further comprising a particular texture indicia associated with each projectile of each group, and distinct from the texture indicia of the projectiles associated with each other group; and wherein said scorecard includes indicia associated with each food group listing indicating the texture indicia for the projectiles of that food group.

8. A game as recited in claim 1 wherein said target comprises a sheet of thermoplastic material, and further comprising means for hanging said sheet of thermoplastic material from a horizontal support.

* * * * *